US005623744A

United States Patent [19]

Triplett et al.

[11] Patent Number: 5,623,744

[45] Date of Patent: Apr. 29, 1997

[54] VACUUM CLEANER

[76] Inventors: Timothy Triplett, 690 Camino Manzanas, Thousand Oaks, Calif. 91360; Wolfgang Beuhler, 402 N. Marcile Ave., Glendora, Calif. 91741

[21] Appl. No.: 569,342

[22] Filed: Dec. 8, 1995

[51] Int. Cl.[6] ..... A47L 5/36

[52] U.S. Cl. ..... 15/326; 15/352; 15/353; 15/339; 15/422.2

[58] Field of Search ..... 15/326, 347, 352, 15/353, 339, 422.2; 55/442

[56] References Cited

U.S. PATENT DOCUMENTS

| | | | |
|---|---|---|---|
| 2,125,850 | 8/1938 | Norris | 15/326 |
| 2,253,310 | 8/1941 | Smellie | 15/326 |
| 3,063,082 | 11/1962 | Rosenberg | 15/353 X |
| 4,015,683 | 4/1977 | Willams | 15/326 X |
| 4,179,768 | 12/1979 | Sawyer | 15/352 |
| 4,193,161 | 3/1980 | Scott | 15/352 |
| 4,586,208 | 5/1986 | Trevarthen | 15/353 X |
| 5,377,383 | 1/1995 | Christensen | 15/353 |

*Primary Examiner*—Chris K. Moore

*Attorney, Agent, or Firm*—Riordan & McKinzie; Scott R. Miller

[57] ABSTRACT

The present invention relates to vacuum systems and more particularly, to systems for cleaning up waste materials and/or recovering materials which might otherwise be considered waste, particularly in industrial uses. The instant invention includes a means for creating and applying a vacuum to a localized area, means for collecting materials and a pair of annular rings connected by a spacer means arranged so as to prohibit retained materials from entering the vacuum creation means and means for minimizing the amount of ambient noise disturbance including a sound dampening sleeve member and a helical spring member fitted within said sleeve. Additional embodiments of the present invention include mounting the vacuum means on a frame having articulated wheels thereon and a frame arranged to allow the collection means to be dumped. The present invention may also include means for determining the level of any fluid collected within the collection means which is easily observable to the operator of the instant vacuum cleaner.

7 Claims, 4 Drawing Sheets

12
62
60
68
66
64
78
84
86
82
80
148
88
116
96
90
70
112
76
74
118
94
65
106
102
10
92
36
100
104
38
98
94
34
46
102
44
106
8
40
108
18
32
110
114
116
8
20
30
22
24

FIG. 3
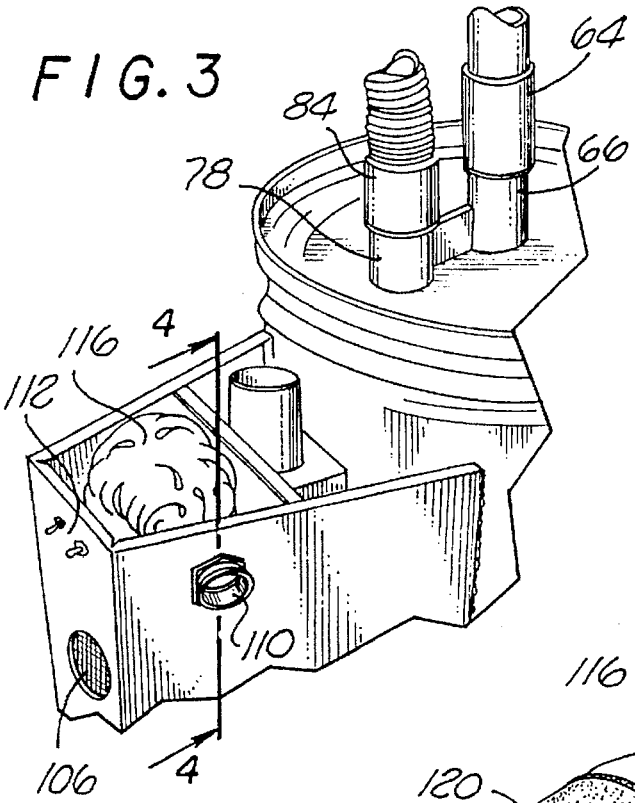
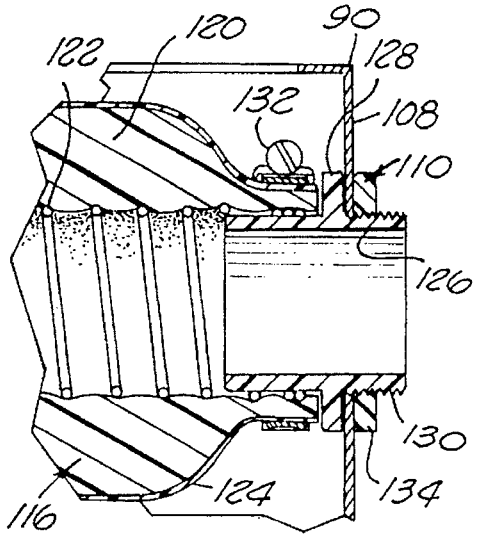
FIG. 4
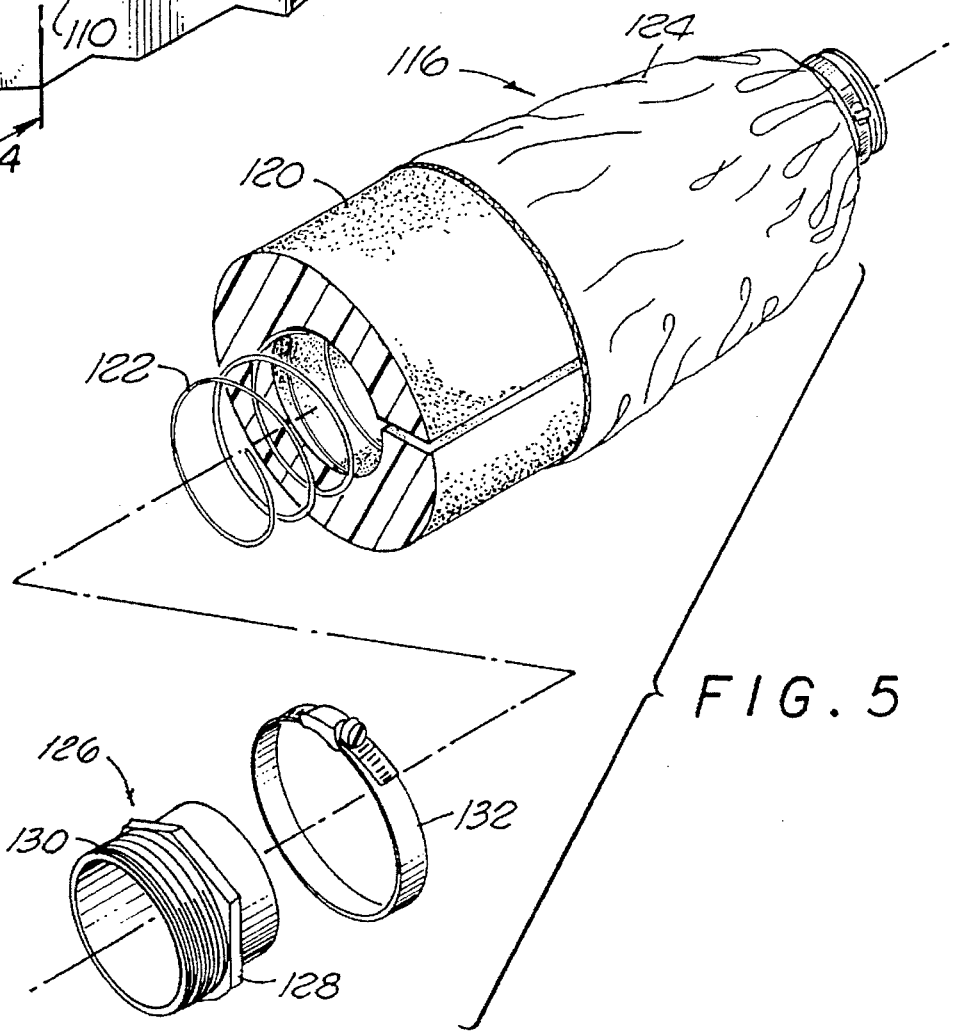
FIG. 5

VACUUM CLEANER

BACKGROUND OF THE INVENTION

The present invention relates to vacuum systems, and more particularly, to systems for cleaning up waste materials and/or recovering materials which might otherwise be considered waste, particularly in industrial uses.

Mechanisms for creating suction and/or vacuums for removing waste and/or unwanted particles in the household application are well known in the art. It is also well known, however, that the use of such devices in industrial settings presents particularly demanding requirements. For example, oftentimes it is desirable to be able to remove waste products having various sizes, shapes and compositions. In many applications, these particles can be of a nature which are dangerous to the operator such as glass particles, metal shavings or other materials which might injure or otherwise threaten the hands and/or feet of the person assigned the task of removing the waste products. Alternatively, it is oftentimes desirable to collect liquid materials for recycling or other types of reuse. Finally, oftentimes it is desirable to remove liquid waste or a combination of liquid waste and particulate waste. Shavings and cutting fluid resulting from cutting, milling, grinding or other activities in a machine shop is one such example. While the nature of the tasks varies, it is highly desirable to provide a mechanism which will recover and/or collect such materials as expeditiously as possible and without excessive noise or disruption of the surrounding environment.

SUMMARY OF THE INVENTION

The present invention provides a mechanism for creating a vacuum and/or suction for removing, collecting and/or recovering waste particles as expeditiously as possible and without creating excessive noise or disruption of the surrounding environment, preferably for use in an industrial environment. Accordingly, it is an effect of the present invention to provide a means for removing, collecting and/or recovering waste materials, which materials may present a substantial danger of injury to the operator where they are to be handled directly by the operator of the present invention. It is a further object of the present invention to provide a means for collecting, removing and/or recovering waste material without creating undue disturbance of the surrounding area. It is a further object of the present invention to provide a vacuum apparatus which includes a means for determining the amount of liquid collected by the apparatus in a convenient manner.

It is a further object of the present invention to provide a vacuuming apparatus which is easily transportable and may be simply emptied either by a single person or by use of a mechanical lifting apparatus such as a forklift or the like.

Other and more detailed objects of the present invention will become apparent to those skilled in the art from the disclosure contained herein.

DESCRIPTION OF THE FIGURES

The present invention will be described more fully in reference to the accompanying drawings, wherein:

FIG. 3 is a partial perspective top view with the top cover of the vacuum cleaner removed;

FIG. 4 is a sectional view taken along line 4—4 of FIG. 3;

FIG. 5 is an exploded perspective view showing the muffler assembly of the present invention;

DETAILED DESCRIPTION OF THE PREFERRED EMBODIMENTS

Figure 1:
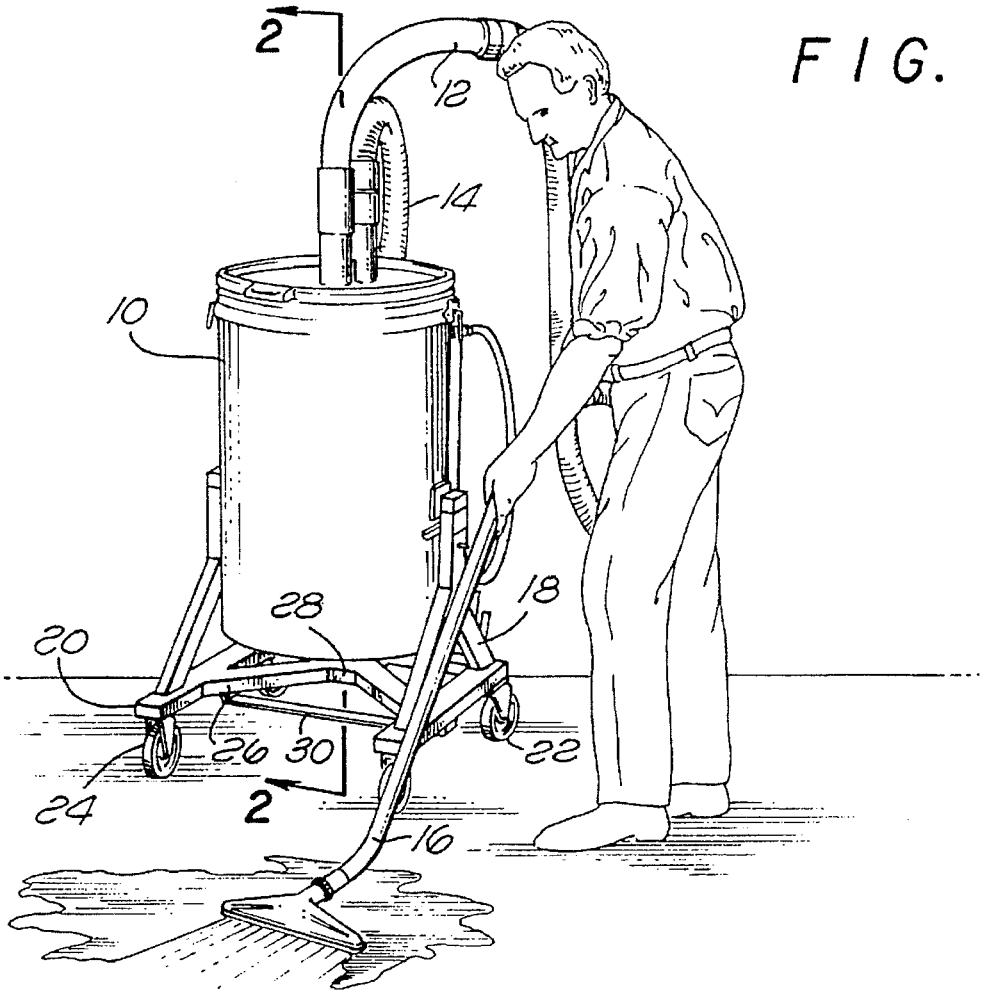
FIG. 1 is a prospective view showing an operator utilizing the present invention.
Figure 9:
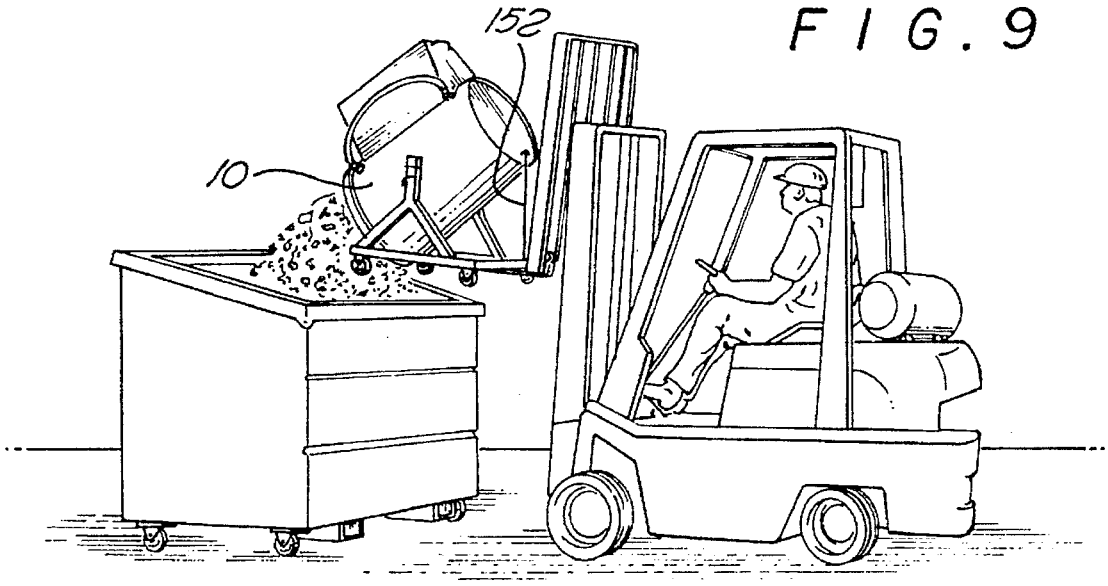
FIG. 9 is a perspective view showing the use of a mechanical apparatus such as a forklift for dumping the contents of the collector barrel of the present invention.
Figure 2:
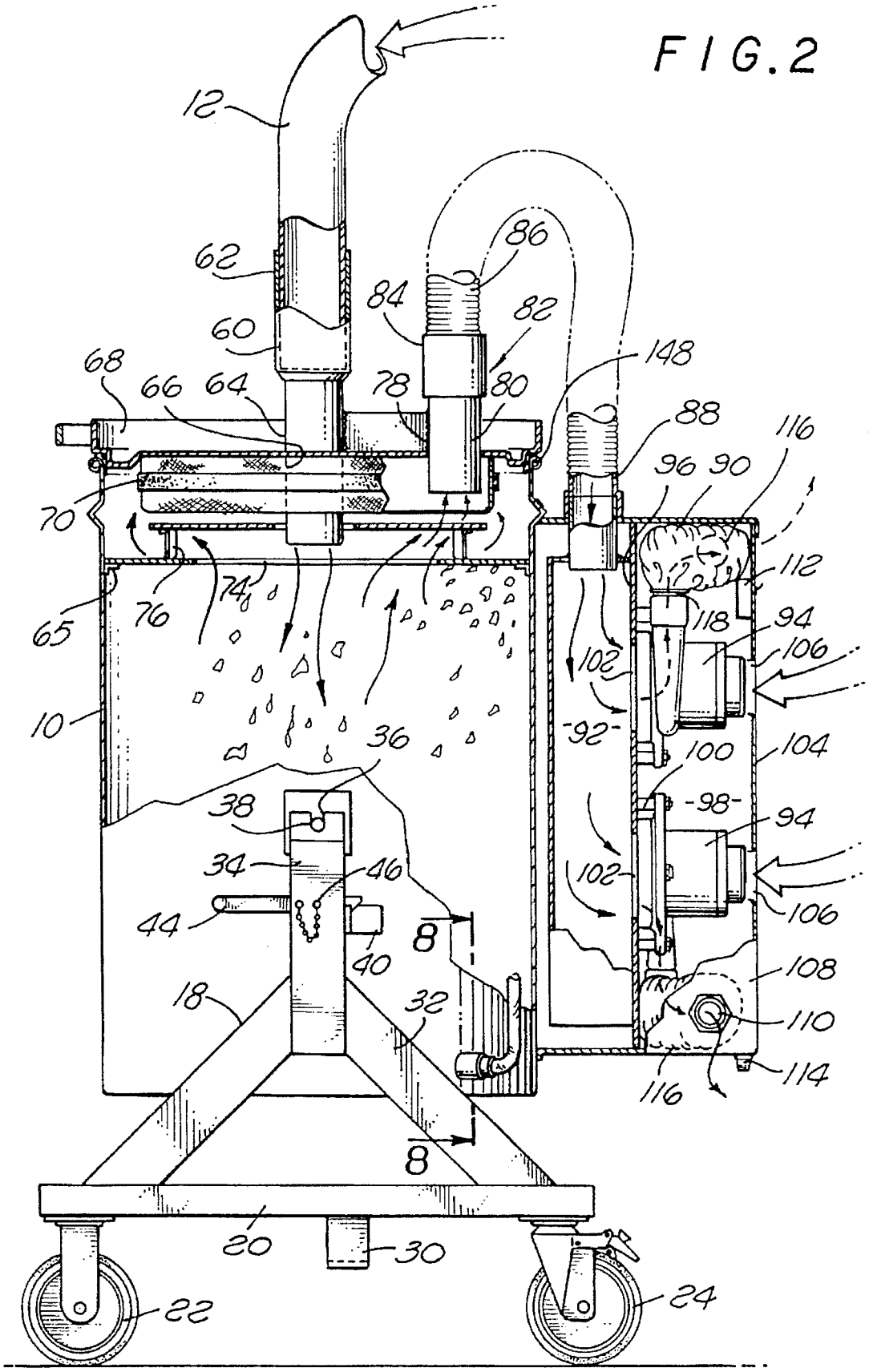
FIG. 2 is a prospective sectional view taken along line 22 of FIG. 1.

As is best illustrated in FIGS. 1 and 2, the present invention includes a collection barrel 10, an inlet hose 12, and a vacuum hose 14. The inlet hose 12 is connected to a cleaning tool 16 of various shapes known within the prior art. The collection barrel 10 is rotatably mounted to a frame 18. In the preferred embodiment, the frame consists of a base member 20 supported by four wheels, two articulated free wheels 22 and two articulated locking wheels 24. The frame 18 also consists of four risers 26 which are rigidly connected to each other at the elevated center point 28 of the frame. A retaining strap 30 is transversely attached to the bottom of the base members 20 to provide additional rigidity and security when the frame is lifted by a mechanical device such as a forklift for purposes of moving, dumping or other transportation of the present invention.

Figure 6:
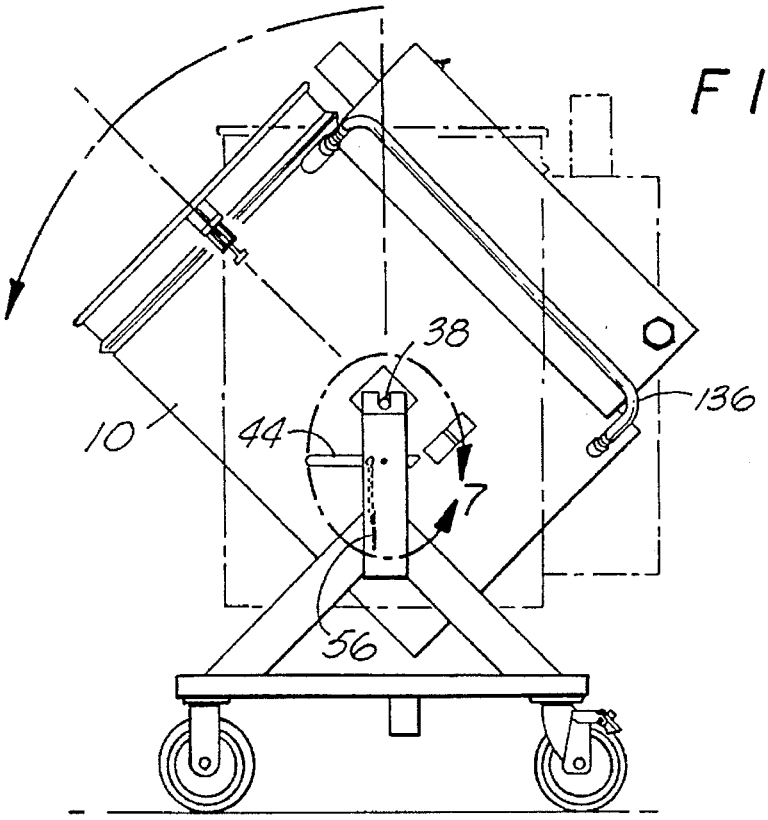
FIG. 6 shows a side elevation of the barrel portion of the present invention tilted for access to the collection barrel with the barrel in the operational position shown in phantom.

Two brace members 32 are fixed to each of the base members 20 and to the pivot member 34. The pivot member 34 contains an open-ended slot 36 in the top of each pivot member 34. A pivoting shaft 38, extending from each side of the collection barrel 10, is rotatably inserted into the open-ended slot 36 of each pivoting member 34 so as to enable the collection barrel to pivot about the axis formed by the two pivoting shafts 38 as is illustrated in FIG. 6. One of the pivot members 34 contains a locking mechanism 40 to interact with a locking member 42 affixed to one side of the collection barrel 10 of the present invention.

Figure 7:
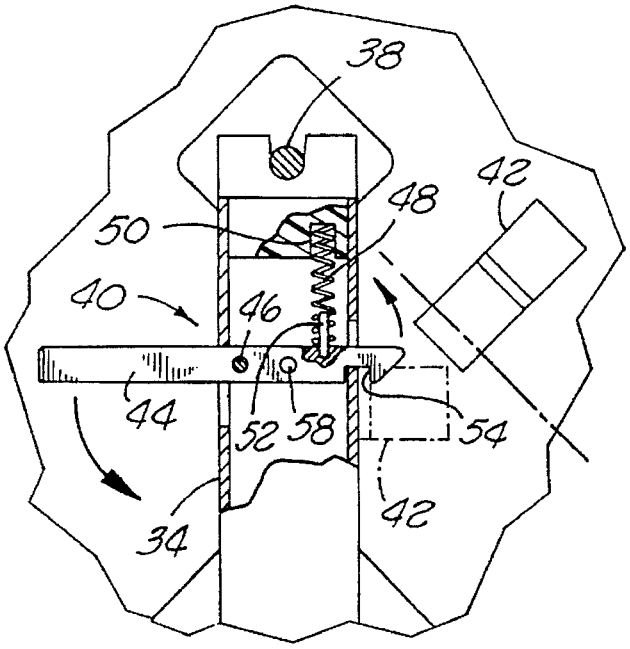
FIG. 7 is a partial sectional side view of the locking mechanism of the present invention showing the mechanism in the unlocked position in solid lines and in the locked position in phantom.

As is best illustrated in FIGS. 2, 6 and 7, the locking mechanism 40 includes a lever member 44 rotatably pinned to the pivot member 34 by a pin 46. A downward force is exerted on the lever member 44 by a spring 48 fitted within a retaining slot 50 in the top of the pivot member 34. The spring 48 is retained on the lever member 44 by means of a retaining pin 52. The spring is chosen such that it exerts a moderate downward force on the lever member 44 when the lever member 44 is in the substantially horizontal position. The lower leading portion of the lever member 44 contains a locking slot which interacts with the top of the distended portion of the locking member 42. The locking mechanism 40 also contains a removable locking pin 56 which fits within locking holes 58 in the lever member 44 and pivot member 34. The locking holes 56 align with one another when the lever member 44 is in the substantially horizontal position. This enables locking pin 56 to be inserted into locking holes 58 so as to secure lever member 44 and prevent its actuation until the locking pin 56 is removed by the operator. The locking mechanism is actuated by applying a downward force on the distended end of lever member 44 causing the leading edge of the lever member to pivot about pivot pin 46, thereby disengaging the locking slot 54 from the distended portion of locking member 42, thereby permitting the collection barrel 10 to pivot about the pivoting shafts 38.

The second end of the inlet hose 12 is connected to a hose inlet nipple 60 having a receiving end 62 for receiving the second end of the inlet hose 12 and an extension end 64 which extends through inlet nipple 66 in the collection barrel lid 68, filter member 70 and the upper baffle member 72. When connected together the extension end 64 of the hose inlet nipple 60 and the inlet nipple 66 form a substantially air tight seal. The upper baffle member 72 is connected to a lower baffle member 74 by a series of annular spaced risers 76. The upper and lower baffle members consist of flat annular rings. The upper baffle member 72 having a center hole which is only slightly larger than the external diameter of the extension end 64 of the inlet nipple 60. The center hole in lower baffle member 74 is substantially in excess of the outside diameter of the extension end 64 of inlet nipple 60. The lower baffle assembly rests on a series of stays 65 affixed to the inside of the collection barrel 10, such that the baffle assembly may be lifted out of the collection barrel 10.

The collection barrel lid 68 is slidably hinged 148 to the collection barrel 10 so as to enable the lid 68 to be conveniently lifted and/or slid off of the slidable pin hinge 148 so as to provide greater access to the inside of the collection barrel 10.

The lid 68 for collection barrel 10 includes a collection receiving nipple 78 which accommodates the extension end 80 of vacuum nipple 82 in such a manner as to create a substantially air tight seal around the outside of the extension end 80 of vacuum nipple 82 and the collection receiving nipple 78. The extension end 80 of vacuum nipple 82 extends partially through the filter member 70. Vacuum nipple 82 also has a receiving end 84 for receiving the first end of a vacuum hose 86 in a substantially air tight manner. The second end of the vacuum hose 86 is attached to the inlet nozzle 88 which extends from the motor housing 90 into the vacuum plenum 92.

In the preferred embodiment shown in the figures two motors 94 are mounted to a mounting plate 96 forming one of the walls of the motor chamber 98. The motors are mounted to the mounting plate 96 by means of flexible bushings using bolts or the like in manners known to those skilled in the art. The mounting plate 96 also forms one wall of the vacuum plenum 92, said mounting plate having two circular air passageways 102 therein. A second side 104 of motor chamber 98 contains air inlets 106 adjacent to the air inlets found on each of the motors 94 in the motor chamber 98. The remaining two sides 108 of motor housing 90 each contain an exhaust hold 110.

The motor housing also includes a control panel 112 for operating the motors 94 mounted in motor housing 90. A handle member 114 is also placed on the bottom of the motor housing 90 in order to assist the operator in the dumping of collection barrel 10 as is described hereinafter. A muffler assembly 116 extends between the motor exhaust port 118 and the motor housing exhaust hole 110.

The muffler member includes an annular dampening member 120 with a spring member 122 fitted therein along the longitudinal axis of the annular dampening member 120. The exterior of the annular dampening member 120 has a cloth-type or PVC cover 124. The annular dampening member 120 is preferably made out of a foam insulating material having sufficient sound dampening properties as to minimize the noise associated with the operation of the vacuum motors 94 in the motor chamber 98 when the present invention is operated. This configuration also allows for the sound damping member to be flexible so that it may be bent or curved to fit within the space available.

In the preferred embodiment, the muffler 116 is connected to the motor housing exhaust hole 110 by means of a nipple 126 having flange 128 annularly disposed about such nipple 126. Preferably, the nipple will have threads 130 on the portion of the nipple extending beyond one side of the annular flange 128. While the portion of the nipple 126 which extends on the other side of the annular flange 128 will have a smooth appearance. A hose clamp 132 is installed about the exterior of the cover 124, the annular dampening member 120, spring member 122 and the unthreaded end of nipple 126. The hose clamp 132 is tightened in a conventional manner so as to secure the first end of the muffler 116 to the outlet nipple 126.

The other end of outlet nipple 126 is secured to the side 108 of motor housing 90 by means of a threaded nut 134. This permits the outlet nipple 126 to be affixed or detached from the motor housing 90 without twisting, injuring or damaging the muffler 116. The second end of the muffler 116 is connected to the exhaust port 118 of the motors in a manner similar to the manner just described or in other manners known to those to those skilled in the art.

When one or more of the motors 94 are activated through the control panel 112, each of the motors 94 operate to create a vacuum in the vacuum plenum 92. This vacuum is sustained by the movement of air and waste materials, particles and/or liquids sought to be retrieved or recovered through inlet hose 12. The air then escapes from the interior of collection barrel 10 by passing through the central hole of the lower baffle plate 72 and by going around the solid portion of upper baffle plate 72 and entering the extension end 80 of vacuum nipple 82. The liquid, waste or particulate matter recovered through inlet hose 12 is not permitted to pass into the vacuum plenum 92 because of the interaction of the upper and lower baffle members. Further, fine particulate matter such as dust or the like is filtered from the air entering the vacuum plenum by means of the filter member 70.

Figure 8:
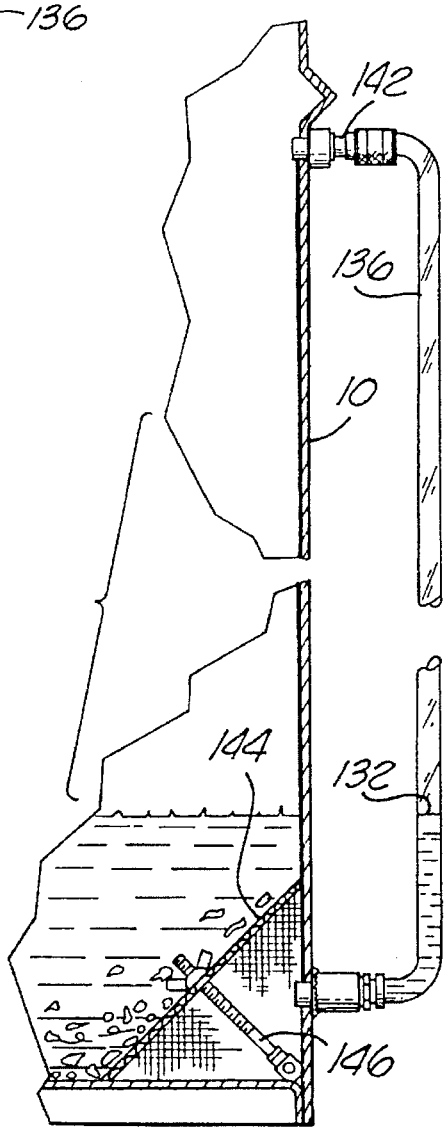
FIG. 8 is a sectional perspective view taken along line 8—8 of FIG. 2.

The present invention also includes a liquid level indicator 136 to enable the user to determine the level of liquid, if any, collected through use of the present invention. In the preferred embodiment, the liquid level indicator 136 includes a flexible tube member 138 having fittings at each end. The inlet fitting 140 is fixedly connected to the lower portion of the collection barrel 10, as best illustrated in FIG. 8. The second end of the flexible tube member 138 is connected to the upper portion of the barrel collection member by means of an exit fitting 142. In the preferred embodiment, the exit fitting 142 is preferably of a quick disconnect type which will enable the upper end of the liquid level indicator to be disconnected from the collection barrel 10, thereby providing alternative means of draining liquid waste from the collection barrel 10. A debris screen 144 is also provided in the lower portion of the collection barrel 10 where the inlet fitting 140 is situated. The debris screen 144 is affixed to the collection barrel, in the preferred embodiment, by means of an anchor bolt 146. So situated, the debris screen 144 will keep debris fron interfering with the operation of the liquid level indicator 136 as hereinabove described.

The present invention provides substantial flexibility in permitting the operator to empty the collection barrel of the present invention. For example, the upper end of the liquid level indicator 136 may be disconnected from the barrel collector portion 10 and placed near a drain or other collection container. This enables the liquid to be transferred out of the collection barrel at a steady pace in a controlled fashion. Alternatively, the operator may wheel the present invention to an appropriate dump site, such as a garbage can or other appropriate collection area, and operate the locking mechanism 40 as hereinabove described so as to tilt the barrel collector 10 of the present invention in such a manner as to facilitate dumping of the barrel collector mechanism. A safety strap 152 extends between the bottom portion of the collection barrel 10 and the frame 18 so as to prevent the collection barrel from rotating too far. Strip clamps, of a type known in the art, may be used on the safety strap 152, to control the amount and/or speed of rotation of the collection barrel 10.

As will be understood to those skilled in the art, all or a portion of the present invention may be utilized in any type of vacuum cleaning apparatus and that the instant invention is limited only by the claims.

We claim:

1. A vacuum cleaner having;

means for creating a vacuum;

means for applying the vacuum created to a localized area;

means for collecting materials retrieved by the localized application of the vacuum;

means for prohibiting said retained materials from entering the means for creating a vacuum, said means including two annular disks connected by spacer means;

means for minimizing the amount of ambient noise disturbance resulting from said means for creating a vacuum, said means including a sound dampening sleeve member and a helical spring member fitted within said sleeve member.

2. A vacuum cleaner as set forth in claim 1 wherein said means for minimizing the amount of ambient noise disturbance is flexible.

3. A vacuum cleaner as set forth in claim 1 wherein said means for collecting materials is pivotly mounted to a frame, said frame having articulated wheels connected thereto and said frame is arranged to allow said collection means to be dumped.

4. A vacuum cleaner as set forth in claim 1 wherein said means for creating a vacuum include two motors mounted to a first wall of a motor housing, said first wall being in fluid connection with a vacuum plenum.

5. A vacuum cleaner as set forth in claim 1 wherein said collection means also includes means for determining the level of any fluid collected therein which is easily observable to the operator of said vacuum cleaner.

6. A vacuum cleaner as set forth in claim 1 wherein said means for prohibiting retrieved materials from entering the means for creating the vacuum further includes a porous filter member, said porous filter member being covered by a screen material, said screen material having perforations therein to not impeded the flow of air therethrough when said means for creating said vacuum is actuated.

7. A vacuum cleaner as set forth in claim 1 wherein said means for collecting retrieved materials includes a means for slidably engaging a forklift in such a way as to permit said collection means to be raised, lowered and transported by a forklift.

* * * * *